United States Patent [19]

Ponting

[11] Patent Number: 4,589,170

[45] Date of Patent: May 20, 1986

[54] SINK FASTENERS

[75] Inventor: Michael A. F. Ponting, Gloucester, Great Britain

[73] Assignee: Springfast Limited, Gloucester, Great Britain

[21] Appl. No.: 620,077

[22] Filed: Jun. 12, 1984

[30] Foreign Application Priority Data

Jun. 14, 1983 [GB] United Kingdom ..... 8316170

[51] Int. Cl.[4] ..... A47B 77/06

[52] U.S. Cl. ..... 24/456; 24/457; 24/458; 24/514; 4/633

[58] Field of Search ..... 24/456, 457, 514, 458, 24/573, 493; 4/632, 633, 634

[56] References Cited

U.S. PATENT DOCUMENTS

| | | | |
|---|---|---|---|
| 514,000 | 2/1894 | Green | 24/514 |
| 1,521,481 | 12/1924 | Spencer | 24/457 |
| 2,658,247 | 11/1953 | Heuer | 24/458 |
| 2,727,248 | 12/1955 | Switzer | 24/456 |
| 2,883,677 | 4/1959 | Geen | 4/634 |
| 3,191,191 | 6/1965 | Juergens | 4/633 |
| 3,510,154 | 5/1970 | Sheff | 24/456 |
| 3,613,128 | 10/1971 | Moyer | 4/633 |
| 3,736,629 | 6/1973 | Blake | 24/514 |
| 3,813,707 | 6/1974 | Fowell | 4/633 |
| 4,432,106 | 2/1984 | Smith | 4/633 |

FOREIGN PATENT DOCUMENTS

| | | | |
|---|---|---|---|
| 0606815 | 12/1932 | Fed. Rep. of Germany | 4/632 |
| 2805452 | 8/1979 | Fed. Rep. of Germany | 4/633 |
| 0876205 | 8/1961 | United Kingdom | 24/456 |
| 0066140 | 12/1982 | United Kingdom | 4/634 |

*Primary Examiner*—Victor N. Sakran
*Attorney, Agent, or Firm*—Young & Thompson

[57] ABSTRACT

A fastener for securing a sink unit in a worktop has a clip (11) for attachment to a rail and a hinged clamping member (12) which is tightened up against the underside of the worktop by a screw (25). This threads through the hinge pin (13), and when undone allows the clamping member to swing back to and stay in an inoperative position where it will clear the edge of the hole of the worktop (19) as the unit (20) is lowered in. Doing up the screw causes the clamping member to swing and project a portion (21) under the worktop. The clamping member has guide fingers (23) which engage diametral slots (24) in the ends of the hinge pin.

3 Claims, 18 Drawing Figures

SINK FASTENERS

Figure 1A:
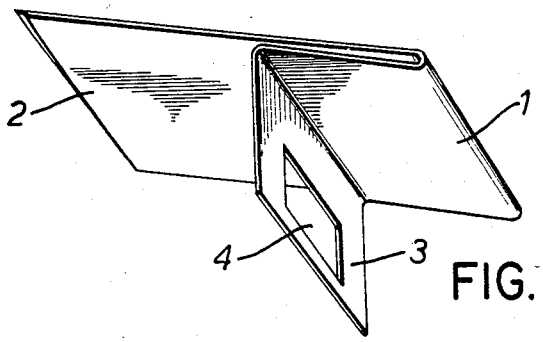
Figure 1B:
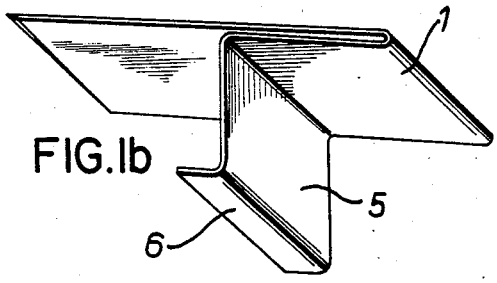
Figure 1C:
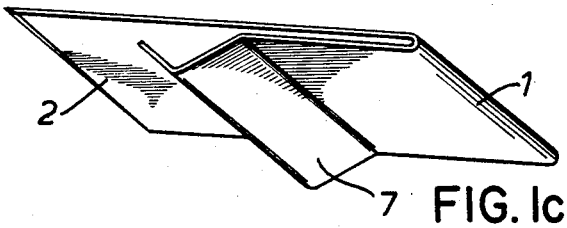
Figure 1D:
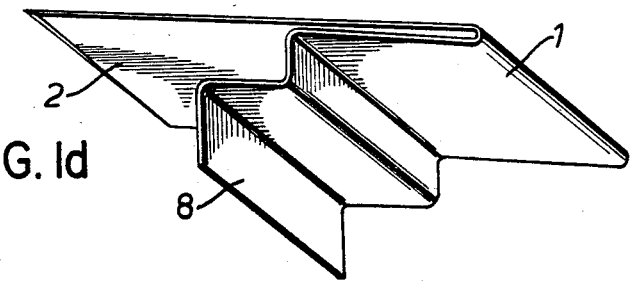

This invention relates to fasteners, and is primarily concerned with a fastener for holding down a sink top to a kitchen base unit.

It is now usual to provide a sink top with an underside formation, hereafter referred to as a rail, to which fastening devices can be clipped. These have some form of screw operated clamping element which can engage under the adjacent edge of the worktop, and when the screw is tightened, so the sink unit is clamped to the worktop.

Most available fasteners of this type are of somewhat complicated construction, but their main fault is that the clamping element, which has to be released as the sink top is dropped into place, tends to swing about and foul the worktop. It can be a fiddle adjusting them so that they all pass down through the hole cut in the worktop together, and when they are tightened up it can be a two-hand job to hold the clamping element as the screw is turned. The alternative is to fit the clamping device after the sink top is in place, but this can be even more awkward.

It is the aim of this invention to simplify the arrangement, and to enable the fastener to be done up one-handed.

According to the present invention there is provided a fastener comprising a clip for positively engaging a rail and a screw-operated clamping member with a hinge pin connection to the base of the clip, the screw being threaded transversely through the hinge pin, and the clamping member being movable between operative and non-operative positions, the latter removing it from projecting to any substantial extent to one side of a rail with which the clip is engaged, while the operative position brings a portion of the member to project to that side.

Preferably, the mutual engagement of the hinge pin, the clip and the clamping member maintains the fastener stable in both said positions. Thus the clamping member will not move under its own weight and that of the screw, and it makes it practicable to attach such fasteners to a sink unit before it is dropped into place. The clamping member is swung to the inoperative position and stays there.

The screw may be arranged to engage the clip as it is tightened and thereby move the clamping member from the inoperative to the operative position as it is also moved towards the rail.

In the preferred form, the clamping member has two hinges parallel to and one each side of the screw, and the hinge pin has guide slots which receive these fingers. This stabilises and guides the clamping member as the screw is operated. These fingers also may be arranged to engage the clip as the screw is tightened, thereby causing the clamping member to move from the inoperative to the operative position as it is also moved towards the rail.

The screw and/or finger engagement with the clip may be with a portion thereof which causes the clamping member to pivot progressively from a first operative position to a second operative position where said portion projects even further to said one side. This makes the fastener more adaptable to a wider range of work tops.

For a better understanding of the invention, some embodiments will now be described, by way of example, with reference to the accompanying drawings, in which:

FIGS. 1(*a*)–(*d*) show cut-away perspective views of various rails, each below the periphery of a sink unit.

Figure 2:
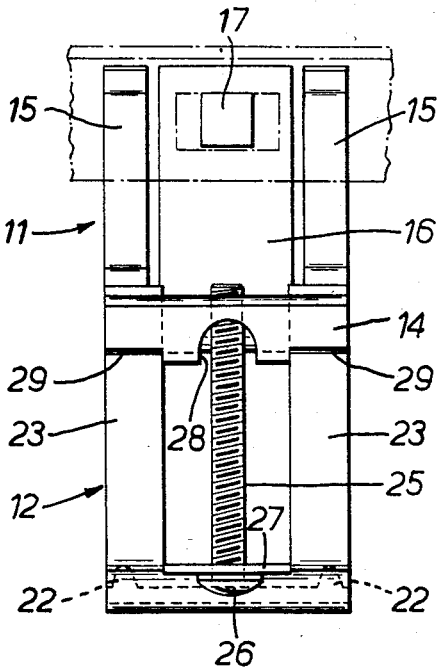
Figure 3:
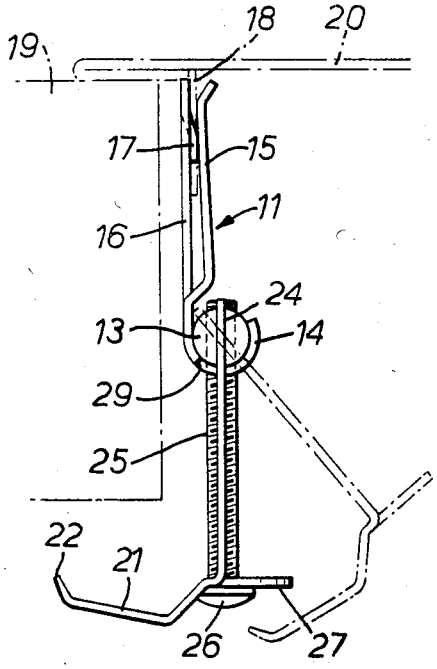
Figure 4:
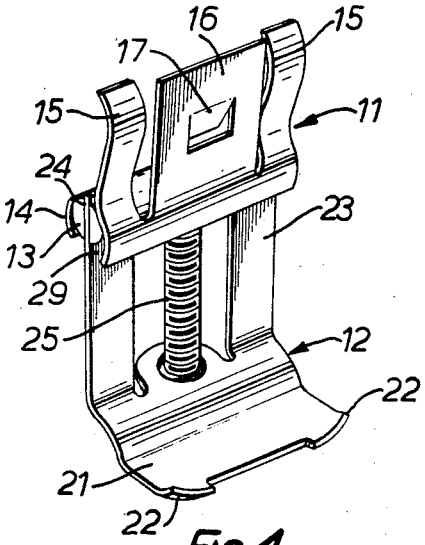
Figure 5A:
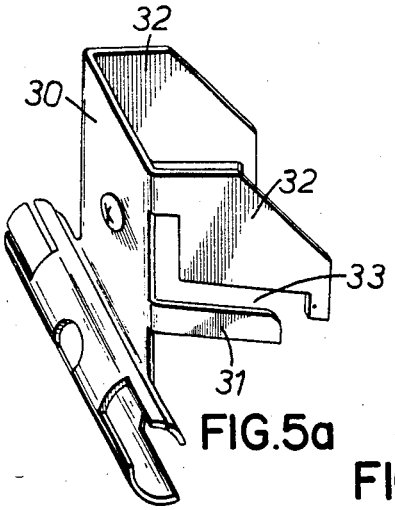
Figure 5B:
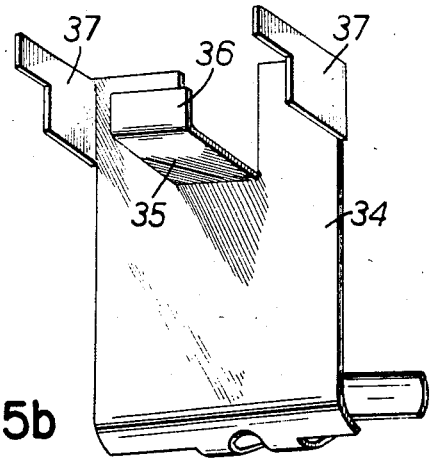
Figure 5C:
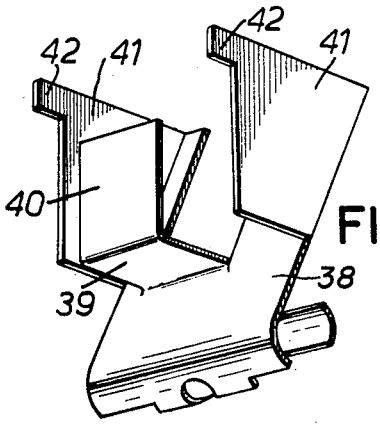
Figure 6A:
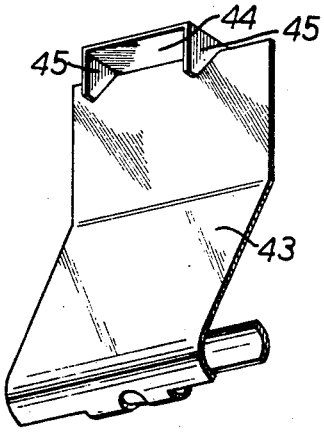
Figure 6B:
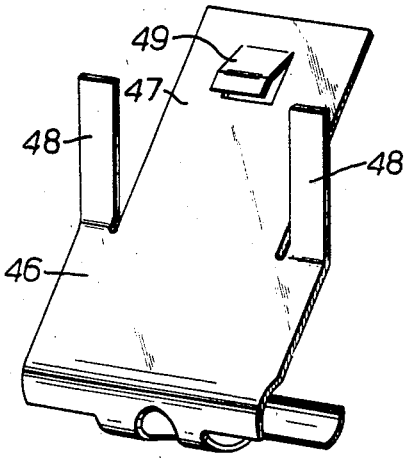
Figure 6C:
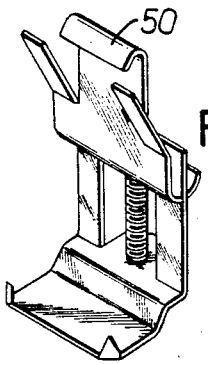
Figure 6D:
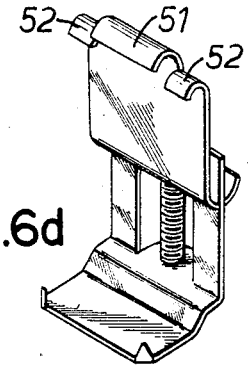
Figure 7A:
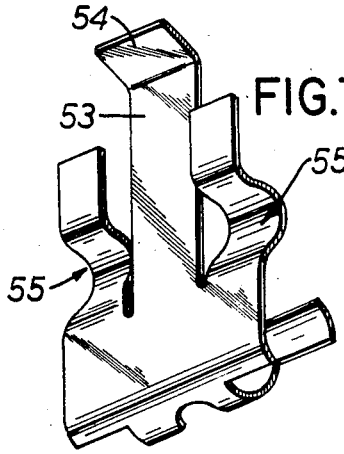
Figure 7B:
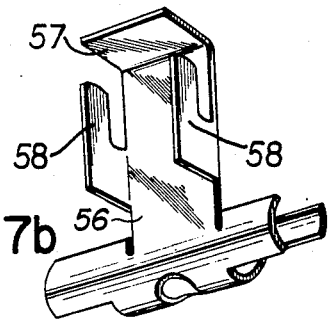
Figure 8A:
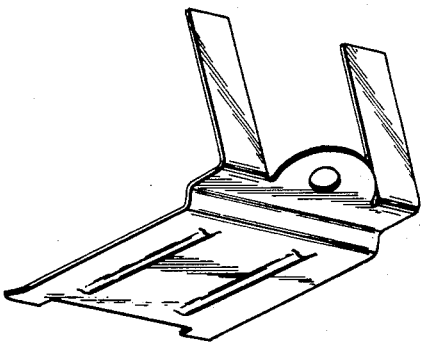
Figure 8B:
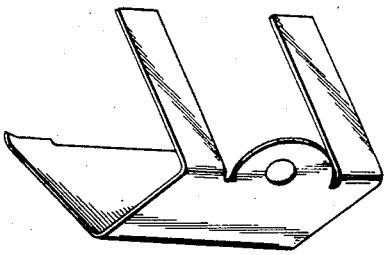

FIG. 2 is a front view of a fastener suitable for use with the rail of FIG. 1 (*a*), FIG. 3 is a side view of the fastener of FIG. 2, FIG. 4 is a perspective view of the fastener of FIG. 2, FIGS. 5(*a*)–(*c*) show in perspective various clips, forming part of corresponding fasteners, suitable for use with the FIG. 1(*b*), FIGS. 6(*a*)–(*d*) show in perspective various clips suitable for use with the rail of FIG. 1(*c*), FIGS. 7(*a*)–(*b*) show in perspective two clips suitable for use with the rail of FIG. 1(*d*), and FIGS. 8(*a*)–(*b*) shown in perspective two alternative clamping members, forming part of corresponding fasteners.

FIG. 1 shows various forms of rails that may be found below the periphery of a sink unit for letting into a worktop. In each case, the periphery of the sink unit has a flange 1 folded back and under to lie against the underside of the main body 2, and the rail is a formation at the inner edge of this flange.

In FIG. 1 (*a*), the rail 3 extends vertically downwards and has a series of rectangular apertures 4, only one of which is shown.

In FIG. 1(*b*), the rail 5 is also generally vertical, but its lower edge portion 6 is bent at right angles to project further inwards.

In FIG. 1(*c*), the rail 7 is of V-form, angling down and inwards from the flange 1, and then up and towards (but not touching) the underside of the body 2.

In FIG. 1(*d*), the rail 8 is of a double stepped form, having portions extending downwardly, inwardly then downwardly again.

These are representative only, and there may well be other kinds of rail in use or proposed. However, they all serve the same function, namely to provide some anchorage point for a clamping device which can be operated to clamp up against the adjacent underside of the worktop. For convenience, the rails described above will be referred to as types A, B, C and D, in conformity with the Figure lettering.

The fastener of FIGS. 2, 3 and 4 has a clip 11 to which is hinged a clamping member 12 through a horizontal hinge pin 13. The clip is integrally formed from metal plate and comprises three arms upstanding from a part-cylindrical base 14 which embraces the hinge pin 13. The two outer arms 15 are narrower than the central arm 16, which has a barb 17 struck out of it. The plane of the arms 15 is slightly offset from that of the arm 16 to accommodate a rail 18 of type A, as indicated in outline in FIG. 3. The barb 17 points downwardly and towards the plane of the arms 15, and engages in an aperture in the rail. To ease initial entry of the rail into the clip, the tips of the arms 15 are curved slightly away from the plane of the arm 16.

Also indicated in outline in FIG. 3 are the edge of a worktop 19 and part of a sink unit 20 from which the rail 18 depends The clamping member 12, also integrally formed from metal plate, is generally L-shaped in side view with a stepped lower flange 21 having upturned corners 22 for engaging under the worktop 19. The other part of this member comprises two fingers 23 which extend upwardly and engage in diametral slots 24 in opposite ends of the pin 13. A screw 25 has its head 26 engaging under a central lug 27 at the rear of the flange 21, and its threaded shank extends up between the fingers 23 to engage a tapped transverse bore in the centre of the pin 13. The base 14 of the clip is cut away at 28 and 29 to accommodate the screw 25 and the fingers 23 over an arc of movement between the full and dotted line positions of FIG. 3.

When the screw is undone to an extent where it no longer projects, up through the pin 13, the clamping member can be pivoted to the dotted line position of FIG. 3. It will be seen that the corners 22 are then vertically below the clip 11, and consequently will clear the edge of the worktop 19 if the unit 20 is moved vertically. The friction between the hinge pin 13 and the base 14 is such that the member 13 will stay in this position when so adjusted. The pin 13 and base 14 may be so formed that there is snap action between the two positions. Thus, it can be normal practice to attach these fasteners to the unit 20 and pivot back the clamping members before dropping the unit into place.

When it is so in place, the clamping member can easily be moved so that the flange 21 projects under the worktop 19, with the screw 25 substantially vertical. This can be done using the screwdriver which is to turn the screw. Indeed, simply by screwing up with the clamping member still in the retracted position, as the end of the screw emerges from the pin so it will engage the arm 16 (or the rail I8 if that extends low enough), and likewise the ends of the fingers 23 will engage the arms 15. Therefore, the clamping member will be automatically wedged into the operative position.

The cut-aways 28 and 29 may be very substantially increased, to the point where the wrap around the hinge pin 13 at those regions is eliminated altogether. This would allow the clamping member to pivot back almost flat against the clip. This can apply to any of the variations shown in subsequent Figures.

FIG. 5 shows various configurations of the clip for engaging a rail of type B.

In FIG. 5(*a*), the clip has a, flat rectangular body 30 with, on each side at right angles to it, a finger 31 and a stepped-edge plate 32 which together form an L-shaped slot 33.

In FIG. 5(*b*), the clip has a flat rectangular body 34, and from the edge remote from the hinge there is a struck out tongue 35 with its extremity 36 bent again to continue parallel to the body 34. This will engage around the outer side of the rail. At the end of each of the longitudinal edges of, and at right angles to, that body there are lugs 37 of squat L-shape. These will hook over the inner side of the rail.

In FIG. 5(*c*), the clip has a flat rectangular body 38 with a tongue 39 struck out from the edge remote from the hinge, but somewhat larger than that of FIG. 5(*b*). Its end portion 40 is also bent, but not so far as to extend parallel to the body 38. The longitudinal edges of that body have trapezoidal flanges 41 bent at right angles on the same side as the tongue 39, and with smaller extensions 42 at the corners farthest from the hinge. Viewed laterally there would appear an L-shaped slot, corresponding to the shape of the rail, which will be engaged thereby. This arrangement will bring the hinge outwards, more directly below the rail.

For a rail of type C, clips as shown in FIG. 6 are suitable.

In FIG. 6(*a*), the clip has a flat rectangular body 43 bent at a shallow angle parallel to the hinge axis at about its mid-length. At the edge remote from the hinge there is a flange 44, whose ends 45 are triangular and bent down to project back towards the hinge, providing a hook formation which will engage in the V-shaped tab. This clip has a particular advantage in increasing the range of worktop thicknesses to which the fastener can adapt. As the screw 25 and/or fingers 23 engage the inclined portion of the body 43 nearest the hinge, so the clamping member will be forced to pivot further, bringing the screw and fingers parallel to that portion. This means that the corners 22 of the flange 21 are swung further under the worktop and upwards to engage its underside earlier than with "straight" clips, and that the fastener is usable on a somewhat thinner worktop than that with which one having a "straight" clip can cope. The clip of FIG. 5(*c*) also has this advantage, and it will be understood that the other clips shown can also be cranked to achieve similar results.

In FIG. 6(*b*), the clip body 46 is longitudinally split a short distance from the hinge to form a wide central portion 47 continuing straight on and lateral fingers 48 bent from their roots at a shallow angle from the main plane. Towards the end of the portion 47, there is a central lug 49 struck out to project in a direction generally opposite to the fingers 48. This will hook over the inner edge of the V-shaped rail while the fingers 48 will engage the undersides of its outer portion.

A variation of this is shown in FIG. 6(*c*) where the clip has a similar main body with angled fingers but instead of the lug 49, the end of the central portion is bent over and back on the same side as the fingers to form a hook 50.

In FIG. 6(*d*), the edge of the clip body remote from the hinge has three hook formations, the central one 51 being similar to the hook 50, and being flanked by two smaller hooks 52 which are slightly nearer the hinge and which do not in fact act as hooks. The hook 51 will engage over the inner lip of the V-rail while the outer faces of the hooks 52 will engage the part of the rail facing downwardly and inwardly.

A selection of clips suitable for attaching to rails of type D are shown in FIG. 7.

In FIG. 7(*a*), the clip has an originally flat rectangular body which is longitudinally divided from the outer edge to near the hinge. This forms three fingers, the central one 53 remaining flat except for its outer end portion 54 which is bent at right angles. The two lateral fingers 55 are deformed substantially midway along their length so that they first project to the side of the finger 53 opposite the portion 54 and then curve back across the plane of the central finger to terminate in portions parallel to the original plane.

In FIG. 7(*b*), the clip has a flat rectangular body 56 with an outer end portion 57 bent at right angles. On the two longitudinal edges, there are L-shaped flanges 58, also bent at right angles to the body 56, which form upwardly open hooks.

These clips can also be used with rails of type A.

The member which clamps to the underside of the worktop may take various forms different from that shown in FIGS. 2 to 4. Two examples are shown in FIG. 8. Occasionally, the edge of the hole in the worktop may be somewhat remote from the tab, and therefore a clamping member with a longer reach is required, such as shown in FIG. 8(*a*). Also, the worktop may be thinner than usual or the rail may be low in relation to its underside. FIG. 8 (*b*) shows a solution to this, alternative to FIG. 6(*a*), where the clamping member is angled back up to engage that underside.

Reference has been made throughout to a rail to which the fasteners are attached, implying a continous formation. This is preferred, particularly for types B, C and D, along which the fasteners can be slid to the most suitable positions. However, it will be understood that a discontinuous formation is possible, and type A, for example, might be reduced to a short tab with a rectangular aperture, since the fastener cannot escape longitudinally.

Also, such fasteners are applicable to more than just sink units. For example, still with kitchen appliances, hobs are frequently let into worktops, and they may be similarly secured.

I claim:

1. A fastener comprising a clip for postively engaging a rail, a clamping member with lateral parallel guide fingers, a hinge pin connecting said member to the base of the clip and having guide slots at its ends to receive said guide fingers, and an intermediate screw-threaded transverse aperture aligned parallel to said slots, a screw engaged in said aperture and co-operating with said clamping member so that rotation of the screw adjusts the position of the clamping member in relation to the clip, and the clamping member being movable about the axis of the hinge pin between stable operative and non-operative positions, the latter removing it from projecting to any substantial extent to one side of a rail with which the clip is engaged, while the operative position brings a portion of the member to project to that side.

2. A fastener as claimed in claim 1 wherein the screw is arranged to engage the clip as it is tightened and thereby move the clamping member from the inoperative to the operative position as it is also moved towards the rail.

3. A fastener as claimed in claim 4, wherein the fingers are arranged to engage the clip as the screw is tightened, thereby causing the clamping member to move from the inoperative to the operative position as it is also moved towards the rail.

* * * * *